United States Patent [19]

Foit

[11] Patent Number: 4,949,855

[45] Date of Patent: Aug. 21, 1990

[54] ANTI-SWAY CRANE REEVING APPARATUS

[75] Inventor: Vilem Foit, Greenfield, Wis.

[73] Assignee: Harnischfeger Corporation, Brookfield, Wis.

[21] Appl. No.: 281,608

[22] Filed: Dec. 9, 1988

[51] Int. Cl.[5] ..... B66C 13/06

[52] U.S. Cl. ..... 212/147; 212/148

[58] Field of Search ..... 212/146, 147, 148

[56] References Cited

U.S. PATENT DOCUMENTS 3,081,884 3/1963 Minty ..... 212/147

FOREIGN PATENT DOCUMENTS 243917 3/1987 German Democratic Rep. ..... 212/147

1424870 2/1976 United Kingdom ..... 212/148

*Primary Examiner*—Sherman D. Basinger

*Assistant Examiner*—Thomas J. Brahan

*Attorney, Agent, or Firm*—Richard C. Ruppin

[57] ABSTRACT

An anti-sway crane reeving apparatus is disclosed in which the reeving apparatus connects an overhead frame carried by a crane, a winding drum means mounted on the frame, and a lifting beam positioned below the frame from which a load carrying means is suspended. A plurality of spaced-apart sheaves are affixed to the lifting beam and rope means is affixed to the drum means and overhead frame and wraps around each of the plurality of sheaves. The rope means functions to support and raise and lower the lifting beam and the load carrying means. The rope means, in extending from its positioned wrapped around each of the plurality of sheaves, diverges from the vertical in an upward direction from each of the plurality of sheaves. The plurality of sheaves on the lifting beam are the only sheaves wrapped by the rope means which are rotatable during raising or lowering of the lifting beam.

10 Claims, 3 Drawing Sheets

ANTI-SWAY CRANE REEVING APPARATUS

FIELD OF THE INVENTION

This invention relates to an anti-sway crane reeving apparatus and, in particular, to a reeving apparatus in which a load lifting means is suspended from a lifting beam and the reeving apparatus is connected between the lifting beam, an overhead frame carried by the crane, and winding drum means mounted on the frame.

DESCRIPTION OF THE PRIOR ART

In current crane designs, there is an emphasis on high capacity which has been attained by increasing the travel speed of the crane upon its tracks and increasing the speed of the load carrying trolley suspended from the frame of the crane. In addition, lifting heights have been raised to thereby increase the amount of material which the crane can span. However, these high speeds and high lifts increase swaying problems of the load lifting means and the load carried by the lifting means which are suspended by a reeving arrangement from the trolley of the crane. During acceleration of the crane on its rails and acceleration of the trolley on its tracks on the frame, and particularly during rapid stopping of the crane frame or the trolley, the load carrying means and load suspended from the reeving is subject to swaying in directions parallel to the movement of the crane frame and the trolley. A high lift ability and consequent long ropes of the reeving increase the amount and velocity of the sway. Where the crane is of the gantry type such as a portal crane handling logs, the picking up of the logs from the side of a pile or the carrying of an unbalanced log load can also result in rotational swaying of the load carrying means and log load which is exacerbated by long reeving ropes.

Reeving arrangements presently in use which are intended to prevent swaying generally have inadequate stiffness to be effective in current fast and high cranes. The resulting swaying presents a danger of damage to the crane and to the load being carried by the crane. Also, substantial swaying results in excessive rope wear since the ropes tend to jump out of the winding grooves of the crane hoist winding drum or rub against sheave flanges or rope guards due to excessive fleet angles.

SUMMARY OF THE INVENTION

It is a general object of this invention to provide a reeving apparatus in which the ropes have a reeving path providing a high degree of stiffness against swaying of the lifting beam, the load carrying means, and the load carried by the load carrying means. It is a further object of this invention to provide a reeving apparatus of a relatively simple type and having a similar high degree of stiffness in both crane travel directions and directions transverse to crane travel.

The invention is carried out by providing a reeving apparatus connected to an overhead frame carried by a crane, winding drum means mounted on the frame, and a lifting beam positioned below the frame from which a load carrying means is suspended. A plurality of spaced-apart sheaves are affixed to the lifting beam and rope means is affixed to the drum means and overhead frame and wraps around each of the plurality of sheaves. The rope means functions to support and raise and lower the lifting beam and the load carrying means. The rope means, in extending from its position wrapped around each of the plurality of sheaves, diverges from the vertical in an upward direction from each of the plurality of sheaves. The plurality of sheaves on the lifting beam are the only sheaves wrapped by the rope means which are rotatable during raising or lowering of the lifting beam.

The plurality of sheaves may be arranged in pairs of sheaves in axial alignment with each other. The rope means may comprise a plurality of pairs of first and second rope means for each pair of sheaves and respectively wrapping around a different one of the sheaves of the same pair of sheaves. Each first and second rope means diverge from each other as they extend away from the sheave in directions transverse to the axis of the sheave pair about which they wrap. The winding drum means may comprise first and second spaced-apart rotatable drums having parallel axes and including circumferential surface areas facing away from each other. Each of the ropes of the plurality of ropes may be affixed to one of the first and second drums such that each of the ropes extend downward from one of the drums at the facing away surface of that drum. The two drums are rotatable in opposite directions to wind the ropes onto the drum circumferential surface.

BRIEF DESCRIPTION OF THE DRAWINGS

Further objects and advantages of the invention will appear when taken in conjunction with the accompanying drawings, in which.

DETAILED DESCRIPTION OF THE INVENTION

Figure 1:
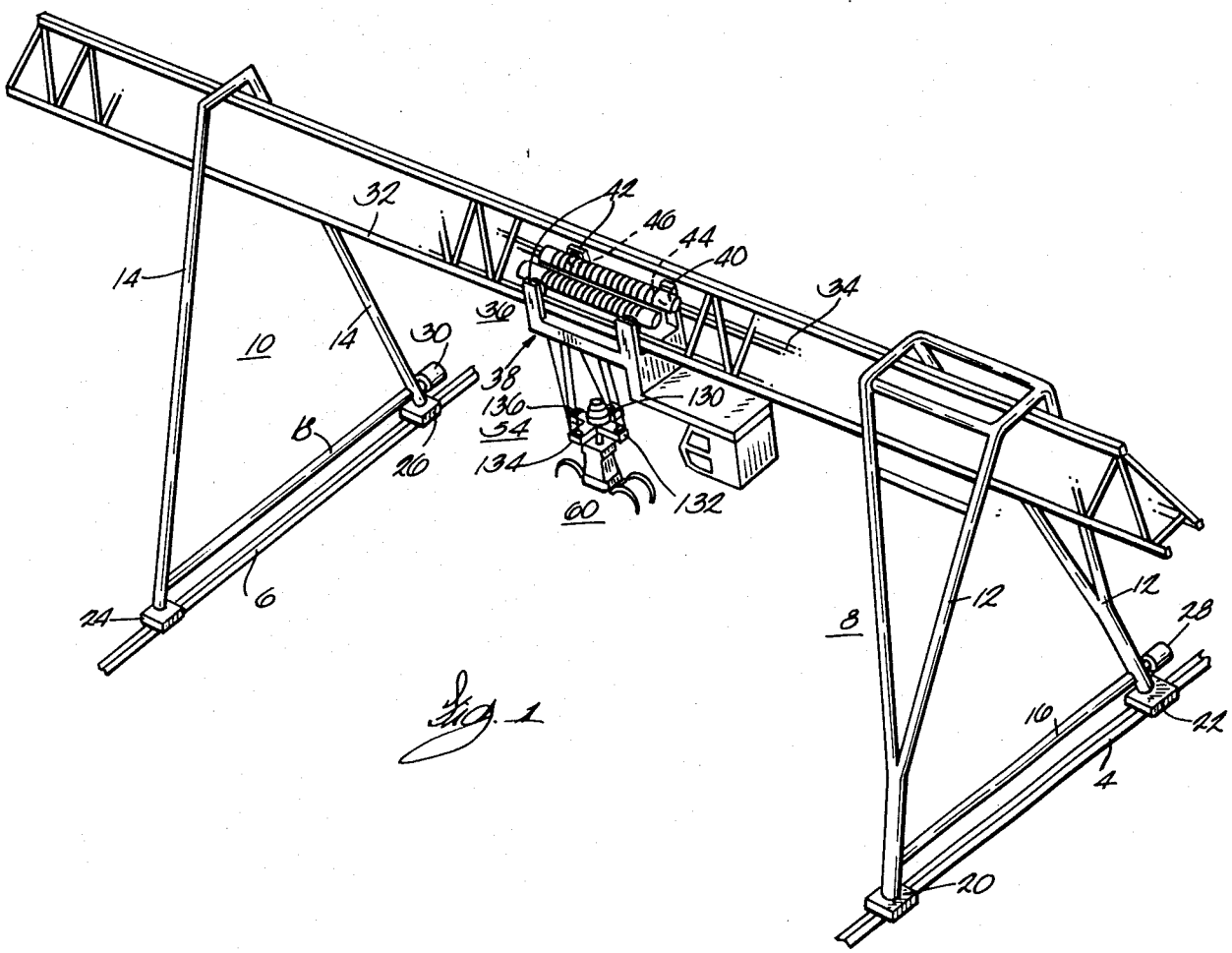
FIG. 1 is a perspective view of a portal crane incorporating the reeving apparatus of the invention.

Referring to FIG. 1 of the drawings, a crane of the portal type incorporating the invention is illustrated as having a frame 2 disposed generally horizontally and overlyding two generally parallel rails 4 and 6, a trolley 36, and two spaced-apart legs 8 and 10 affixed to the frame 2. The rails 4 and 6 run through a storage area for material which is to be lifted and transported into and out of the storage area by the crane. The legs respectively include elongated members 12 and 14, lower bases 16 and 18, and spaced-apart wheel assemblies 20, 22, and 24, 26. The wheel assemblies 20, 22 engage and ride on the rail 4 and the wheel assemblies 24, 26 engage and ride on the rail 6. Wheel drive motors 28 and 30 are mounted on wheel assemblies 22 and 26. When drive by the motors 28 and 30 the portal crane travels along the rails 4 and 6 through the material storage area.

The frame 2 includes a pair of parallel tracks 32 and 34 on which a trolley 36 is carried for travel along the length of the frame 2. The trolley 36 includes an overhead frame 38 from which two pair of legs 40 and 42 extend upwardly and on which a pair of trolley support wheels 44 and 46 are mounted. The wheels 44 and 46 engage the tracks 32 and 34 and support the trolley on the tracks. A trolley drive motor 48 is mounted on one of the pair of legs 46 and drives the wheels 42. A guard rail 50 is affixed to the trolley frame 38 for safety purposes during maintenance of the trolley and an operator cab 52 is also mounted on the trolley.

Figure 2:
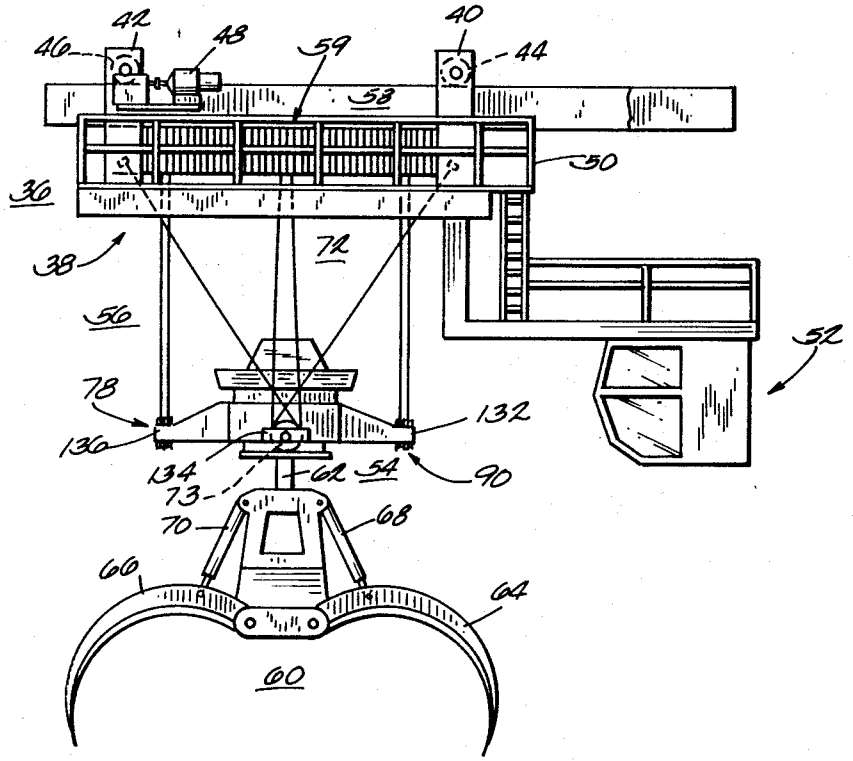
FIG. 2 illustrates a reeving apparatus according to the invention connecting an overhead trolley and a lifting beam from which a load carrying means is suspended.
Figure 3:
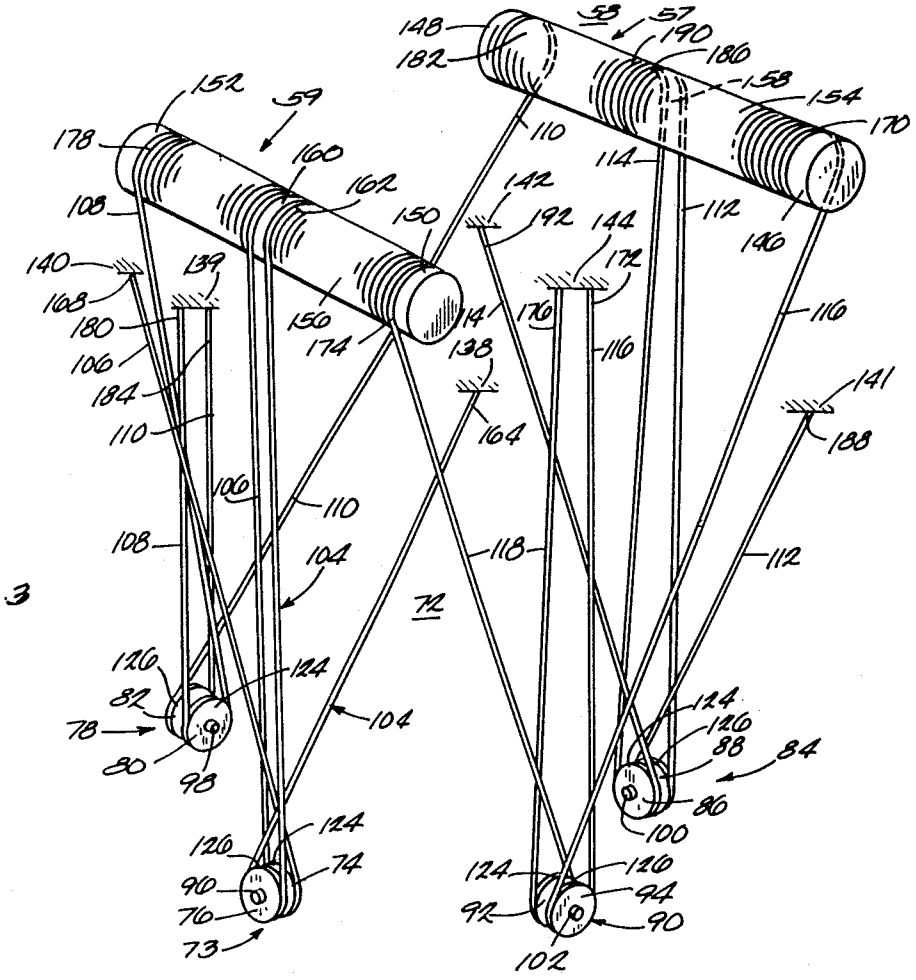
FIG. 3 is a simplified reeving diagram for the reeving apparatus.

With reference to FIG. 2, a generally cruciform shaped lifting beam 54 is suspended from the trolley 36 by a reeving apparatus 56 which is affixed to the overhead frame 38 of the trolley, to winding drum means 58 comprising rotatable drums 57 and 59 mounted on the trolley frame 38, and to the lifting beam 54. As shown in FIG. 3, the drums 57 and 59 are spaced apart with their axes parallel to each other. A load carrying means such as a grapple 60 is rotatably connected to the lifting beam 54 by means of a double articulated joint 62 which permits pivoting of the grapple 60 about perpendicular and horizontal axes. The grapple 60 includes a pair of cylinders 68 and 70 which open and close a pair of load carrying arms 64 and 66 for grasping material to be lifted and transported by the crane. The operation of the grapple 60 including the load carrying arms 64 and 66, the winding drum means 58, the movement of the trolley 36, and the movement of the crane on the rails 4 and 6 is controlled from the operator cab 52 to lift, transport and set sown material within the travel range of the crane and the trolley.

The reeving apparatus 56, as shown in FIGS. 2 and 3, includes a rope means 72 and a plurality of sheaves including sheave pair 73 comprising sheaves 74, 76, sheave pair 78 comprising sheaves 80, 82, sheaves pair 84 comprising sheave 86, 88, and sheave pair 90 comprising sheaves 92, 94. The sheave pairs 73, 78, 84 and 90 are respectively mounted on the ends 134, 136, 130 and 132 of the lifting beam 54. The mounting of the sheave pairs on the lifting beam ends is accomplished by mounting the sheave pairs 73, 78, 84 and 90 respectively on axles 96, 98, 100 and 102 which, in turn, are respectively mounted on lifting beam ends 134, 136, 130 and 132. The groove in each of the sheaves is designated by the numeral 124. The axles 102 and 98 are most desirably parallel to the axes of drums 57 and 59 and the axles 96 and 100 are desirably transverse to the axes of drums 57 and 59. The rotatable drums 57 and 59 each have opposite ends 146, 148 and 150, 152. The ends 146 and 150 of the drums 57 and 59 are at the same axial end of the two drums and the ends 148 and 152 are at the opposite axial end of the two drums. The ends 146 and 150 are most adjacent each other and the ends 148 and 152 are most adjacent each other. The drums 57 and 59 also respectively have circumferential surfaces 154 and 156 which have surface portions 158 and 160 facing away or in opposite directions from each other.

The rope means 72 includes a plurality of ropes 104, 106, 108, 110, 112, 114, 116 and 118, each of which follow a separate path from one of the drums down to one of the plurality of sheaves and upward to an anchoring location on the overhead frame 38. The rope 104 has an upper portion 162 wrapped around and affixed to the drum 59 intermediate the ends 150 and 152 of the drum 59 and extending in a substantially vertical direction to and around the sheave 76 of the sheave pair 73 in groove 126. The rope 104 then extends upward at an angle diverging from the vertical in a direction transverse to the axle 96 of the sheave pair 73 and in a direction parallel to the axes of the drums 57 and 59 to an end portion 164 affixed to an anchor location 138 on trolley frame 38. The rope 106 has a portion 166 wrapped around and affixed to the drum 59 intermediate the ends 150 and 152 and extending in a substantially vertical direction to and around the sheave 74 of sheave pair 73 in groove 124. The rope 106 then extends upward at an angle diverging from the vertical in a direction transverse to the axle 96 of the sheave pair 73 and in a direction parallel to the axes of the drums 57 and 59 to end portion 168 affixed to an anchor location 140 on trolley frame 38. Considered together, the ropes 104 and 106 diverge from each other in an upward direction and cross each other's paths in extending upward when viewed in an axial direction of the pair of sheaves 73. The rope 116 has a portion 170 which wraps around and is affixed to the end 146 of the drum 57 and extends at an angle divergent from the vertical in a direction transverse to the axle 102 of the sheave pair 90 to and wraps around sheave 94 of the pair of sheaves 90 in the groove 126. The rope 116 then extends substantially vertically upward to an end portion 172 and is affixed to the trolley frame 38 at an anchor location 144. The rope 118 has a portion 174 which wraps around and is affixed to the end 150 of the drum 59 and extends at an angle divergent from the vertical in a direction transverse to the axle 102 of the sheave pair 96 to and wraps around the sheave 92 of the sheave pair 90 in groove 124. The rope 118 then extends upward to an end portion 176 which is affixed to the trolley frame 38 at the anchor location 144. The rope 112 has an upper portion 186 wrapped around and affixed to the drum 57 intermediate the ends 146 and 148 of the drum 57 and extending in a substantially vertical direction to and around the sheave 88 of the sheave pair 84 in groove 126. The rope 112 then extends upward at an angle diverging from the vertical in a direction transverse to the axle 100 of the sheave pair 84 and in a direction parallel to the axes of the drums 57 and 59 to an end portion 188 affixed to an anchor location 141 on trolley frame 38. The rope 114 has a portion 190 wrapped around and affixed to the drum 57 intermediate the ends 146 and 148 and extending in a substantially vertical direction to and around the sheave 86 of sheave pair 84 in groove 124. The rope 114 then extends upward at an angle diverging from the vertical in a direction transverse to the axle 100 of the sheave pair 84 and in a direction parallel to the axes of the drums 57 and 59 to end portion 192 affixed to an anchor location 142 on trolley frame 38. Considered together, the ropes 112 and 114 diverge from each other in an upward direction and cross each other's paths in extending upward when viewed in an axial direcion of the pair of sheaves 84. The rope 110 has a portion 182 which wraps around and is affixed to the end 148 of the drum 57 and extends at an angle divergent from the vertical in a direction transverse to the axle 98 of the sheave pair 78 to and wraps around sheave 82 of the pair of sheaves 78 in the groove 126. The rope 110 then extends substantially vertically upward to an end portion 184 and is affixed to the trolley frame 38 at an anchor location 139. The rope 108 has a portion 178 which wraps around and is affixed to the end 152 of the drum 59 and extends at an angle divergent from the vertical in a direction transverse to the axle 102 of the sheave pair 96 to and wraps around the sheave 80 of the sheave pair 78 in groove 124. The rope 108 then extends upward to an end portion 180 which is affixed to the trolley frame 38 at the anchor location 139.

Acceleration or deceleration, particularly at a rapid rate, by the crane as it travels on the rails 4 and 6 or by the trolley 36 as it travels on the tracks 32 and 34 will result in swaying forces on the lifting beam 54 tending to cause swaying of the lifting beam, load carrying means 60 and any load that it may be carrying in the directions of the crane travel or in the directions of the trolley travel. Also, picking up of unbalanced loads or loads requiring the load carrying means 60 to be positioned at an angle, may result in forces tending to cause rotational swaying about a vertical axis. The reeving apparatus disclosed herein provides a high resistance to swaying forces with a very simple reeving arrangement. In particular, the reeving arrangement accomplishes the resistance to swaying forces with load carrying sheaves, which rotate with the drums 57 and 59 to raise and lower a load, only on the lifting beam 54. There are no load carrying sheaves of this type about which the ropes wrap which are mounted on the overhead trolley frame 38. The high level of resistance to swaying forces is provided using a plurality of ropes, each of which extends downward from a drum only once and wraps around a sheave and extends upward only once to an anchor location on the trolley frame. Each of the ropes extending upward from a sheave diverge from the vertical. The wrapping of each rope around only one sheave and the diverging direction of the ropes both contribute to an arrangement which provides a high level of force which resists swaying forces on the lifting beam and load carried by the lifting beam. The crossing of the paths of each rope extending to and extending away from a sheave on the lifting beam also contributes to the anti-swaying force provided by the reeving apparatus.

It will be understood that the foregoing description of the present invention is for purposes of illustration only and that the invention is susceptible to a number of modifications or changes none of which entail any departure from the spirit and scope of the present invention as defined in the hereto appended claims.

I claim:

1. A reeving apparatus for a crane having an overhead frame, winding drum means mounted on the frame, a lifting beam positioned below the frame and subject to swaying forces transverse to the vertical, and load carrying means suspended from the lifting beam, comprising:

a plurality of spaced-apart rotatable sheaves affixed to the lifting beam and each having an axis; and rope means affixed to the drum means and overhead frame for supporting and raising and lowering the lifting beam and load carrying means, the rope means including a plurality of ropes each wrapped around one of the plurality of sheaves and each having first and second rope portions extending upward away from the sheave around which each rope wraps, said first and second portions crossing each other when viewed in the axial direction of the sheave around which the rope of which they are a part wraps.

2. The reeving apparatus according to claim 1 wherein:

the plurality of sheaves comprises a plurality of pairs of sheaves, the sheaves of each pair of sheaves being in axial alignment with each other; and the plurality of ropes comprises a plurality of pairs of first and second ropes, the first and second ropes of each rope pair respectively wrapping around a different one of the sheaves of the same pair of sheaves and having a position in which one of the portions of a rope of each rope pair diverges from one of the portions of the other rope of the same rope pair in a direction transverse to the axes of said same pair of sheaves.

3. The reeving apparatus according to claim 2 wherein the plurality of pairs of ropes comprise first, second, third and fourth pairs of ropes, one of the rope portions of one rope of each of the first and second pairs of ropes extend substantially in a vertical direction from one of the pairs of plurality of sheaves to the overhead frame and one of the rope portions of one rope of each of the third and fourth pairs of ropes extend substantially in a vertical direction from one of the pairs of plurality of sheaves to one of the rotatable drums.

4. A reeving apparatus for a crane having an overhead frame, a lifting beam positioned below the frame and subject to swaying forces transverse to the vertical and load carrying means suspended from the lifting beam, comprising:

a plurality of spaced-apart pairs of rotatable sheaves affixed to the lifting beam, each sheave of each pair of sheaves having an axis;

rope means including a plurality of ropes affixed to the overhead frame and each wrapped around one sheave of one of the pairs of sheaves for supporting the lifting beam and load carrying means each of the plurality of ropes having first and second portions extending upward away from the sheave about which each rope wraps, said first and second portions crossing each other when viewed in the axial direction of the sheave about which they wrap; and first and second spaced-apart rotatable drum means having parallel axes and circumferential surfaces including facing away surface areas, each of the ropes being affixed to one of the first and second drum means and extending from one of said drum means at said facing away surface of the one drum means, the first drum means being rotatable in one direction to wind the ropes affixed to the first drum onto its circumferential surface, the second drum means being rotatable in an opposite direction to said one rotation direction of the first drum to wind the ropes affixed to the second drum onto its circumferential surface.

5. A reeving apparatus for a crane having an overhead frame, winding drum means mounted on the frame, a lifting beam positioned below the frame and subject to swaying forces transverse to the vertical, and load carrying means suspended from the lifting beam, comprising:

a plurality of sheaves comprising a plurality of pairs of spaced-apart rotatable sheaves, the sheaves of each pair being in axial alignment with each other;

rope means affixed to the drum means and overhead frame for supporting and raising and lowering the lifting beam and load carrying means, the rope means comprising a plurality of pairs of first and second ropes, the first and second ropes of each rope pair respectively wrapping around a different one of the sheaves of the same pair of sheaves and having a position diverging from each other in directions transverse to the axis of said same pair of sheaves.

6. A reeving apparatus for a crane having an overhead frame, a lifting beam positioned below the frame and subject to swaying forces transverse to the vertical, and load carrying means suspended from the lifting beam, comprising:

winding drum means mounted on the frame and comprising first and second spaced-apart rotatable drums having parallel axes and adjacent first ends and adjacent second ends:

the frame has a section adjacent the first ends of the drums and a section adjacent the second ends of the drums;

a plurality of sheaves comprising a plurality of spaced-apart pairs of rotatable sheaves affixed to the lifting beam, the sheaves of each pair of sheaves being in axial alignment with each other;

rope means comprising at least four pairs of first and second rope means affixed to the drum means and overhead frame for supporting and raising and lowering the lifting beam and load carrying means;

the first and second rope means of each rope means pair respectively wrapping around a different one of the sheaves of the same pair of sheaves and having a position diverging from each other transverse to said same pair of sheaves;

a first pair of first and second rope means has its first and second rope means extending from one of said pair of sheaves and respectively affixed to the first end of the first drum and the first end of the second drum and a second pair of first and second rope means has its first and second rope means extending from a second pair of said sheaves and respectively affixed to the second end of the first drum and to the second end of the second drum whereby the first and second pair of first and second rope means are in said diverging position;

third and fourth pairs of first and second rope means have their first rope means affixed to said frame section adjacent the first ends of the first and second drums and have their second rope means affixed to said frame section adjacent the second ends of the first and second drums whereby the third and fourth pair of first and second rope means are in said diverging position; and the first and second rope means of the first and second pairs of first and second rope means each have a rope portion extending substantially in a vertical direction from one of the pairs of plurality of sheaves to the overhead frame and the first and second rope means of the third and fourth pairs of said first and second rope means each have a rope portion extending substantially in a vertical direction from one of the pairs of plurality of sheaves to one of the rotatable drums.

7. A reeving apparatus for a crane having an overhead frame, winding drum means mounted on the frame, a lifting beam positioned below the frame and subject to swaying forces transverse to the vertical, and load carrying means suspended from the lifting beam, comprising:

a plurality of sheaves comprising a plurality of spaced-apart pairs of rotatable sheaves affixed to the lifting beam, the sheaves of each pair of sheaves being in axial alignment with each other;

rope means affixed to the drum means and overhead frame for supporting and raising and lowering the lifting beam and load carrying means, the rope means comprising a plurality of ropes each having only two portions extending upwardly from one of the plurality of sheaves, a first of said portions extending to the drum means and a second of said portions having an upper end section anchored to the overhead frame;

first and second ones of said plurality of ropes have said first portions extending upward substantially vertically from a first one of said pairs of sheaves to the drum means and said second portions extending upward from said first one of the plurality of pairs of sheaves at an angle relative to the vertical and transverse to the axis of said first one of the plurality of pairs of sheaves;

third and fourth ones of said plurality of ropes have said first portion extending upward substantially vertically from a second one of said pairs of sheaves to the drum means and said second portions extending upward from said second one of the plurality of pairs of sheaves at an angle relative to the vertical and transverse to the axis of said second one of the plurality of pairs of sheaves;

fifth and sixth ones of said plurality of ropes have said first portions extending upward from a third one of said pairs of sheaves at an angle relative to the vertical and transverse to the axis of said third one of the plurality of pairs of sheaves to the drum means and said second portions extending upward substantially vertically from said third one of the plurality of pairs of sheaves; and seventh and eighth ones of said plurality of ropes have said first portions extending upward from a fourth one of said pairs of sheaves at an angle relative to the vertical and transverse to the axis of said fourth one of the plurality of pairs of sheaves to the drum means and said second portions extending upward substantially vertically from said fourth one of the plurality of pairs of sheaves.

8. A reeving apparatus for a crane having an overhead frame, a lifting beam positioned below the frame and subject to swaying forces transverse to the vertical and load carrying means suspended from the lifting beam, comprising:

a plurality of sheaves comprising first, second, third and fourth spaced-apart pairs of rotatable sheaves affixed to the lifting beam;

first and second spaced-apart rotatable drum means having parallel axes and circumferential surfaces including facing away surface areas, each first and second drum means having first and second opposite ends, the first ends of both drum means extending in the same first axial direction and the second ends of both drum means extending in an opposite second axial direction;

rope means including first through eighth ropes affixed to the overhead frame;

the first and second ropes respectively being affixed to the first drum means and the second drum means, the first and second ropes respectively extending downward to the first pair of sheaves from the first end of the first drum means at the surface area of the latter and downward from the first end of the second drum means at the surface area of the latter, the first and second ropes respectively wrapping around different ones of the first pair of sheaves and extending upward substantially vertically to the overhead frame;

the third and fourth ropes being affixed to the second drum means and extending downward to the second pair of sheaves from the second drum means at the surface area of the latter and intermediate the first and second ends of the second drum means, the third and fourth ropes respectively wrapping around different ones of the second pair of sheaves and extending upward to the frame in directions diverging from each other and parallel to the axes of the drum means;

the fifth and sixth ropes respectively being affixed to the first drum means and the second drum means, the fifth and sixth ropes respectively extending downward to the third pair of sheaves from the second end of the first drum means at the surface area of the latter and downward from the second end of the second drum means at the surface area of the latter, the fifth and sixth ropes respectively wrapping around different ones of the third pair of sheaves and extending upward substantially vertically to the overhead frame;

the seventh and eighth ropes both being affixed to the first drum means and extending downward to the fourth pair of sheaves from the first drum means at the surface area of the later and intermediate the first and second ends of the first drum means, the seventh and eighth ropes respectively wrapping around different ones of the fourth pair of sheaves and extending upward to the frame in directions diverging from each other and parallel to the axes of the drum means; and the first drum means is rotatable in one direction to wind the first, fifth, seventh and eighth ropes on to its circumferential surface, the second drum means being rotatable in an opposite direction to said one rotation direction of the first drum means to wind the second, third, fourth and sixth ropes on to its circumferential surface.

9. The reeving apparatus according to claim 8 wherein said pairs of sheaves are the only sheaves that rotate in response to rotation of one of the drums.

10. The reeving apparatus according to claim 9 wherein:

each sheave of a pair of sheaves has an axis; and each of the plurality of ropes have first and second portions extending away from the sheave about which each rope wraps, said first and second portions crossing each other when viewed in the axial direction of the sheave about which they wrap.

* * * * *